US005393925A

United States Patent [19]

Wilson

[11] Patent Number: 5,393,925

[45] Date of Patent: Feb. 28, 1995

[54] APPARATUS FOR PLAYING A STRINGED INSTRUMENT

[76] Inventor: Gary D. Wilson, 88 Columbia Pl. NW, Calgary, Alberta, Canada, T2L 0R5

[21] Appl. No.: 126,895

[22] Filed: Sep. 27, 1993

[30] Foreign Application Priority Data

Mar. 18, 1993 [CA] Canada ..... 2089962

[51] Int. Cl.[6] ..... G10F 1/20

[52] U.S. Cl. ..... 84/9; 84/321

[58] Field of Search ..... 84/8, 9, 320, 321

[56] References Cited

U.S. PATENT DOCUMENTS

| | | | |
|---|---|---|---|
| 1,871,021 | 8/1932 | Zachrison | 84/321 |
| 2,550,276 | 4/1951 | Lenz | 84/321 |
| 3,443,468 | 5/1969 | Kidwell | 84/315 |
| 4,037,503 | 7/1977 | Jacobson et al. | 84/9 |

FOREIGN PATENT DOCUMENTS

| | | | |
|---|---|---|---|
| 66519 | 3/1900 | Canada | 84/133 |
| 80074 | 3/1902 | Canada | 84/80 |
| 104111 | 3/1907 | Canada | 84/33 |
| 146959 | 4/1918 | Canada . | |
| 273986 | 9/1927 | Canada . | |
| 1043141 | 11/1978 | Canada | 84/33 |
| 1151452 | 8/1983 | Canada | 84/35 |

*Primary Examiner*—Michael L. Gellner
*Assistant Examiner*—Patrick J. Stanzione

[57] ABSTRACT

An apparatus for playing a stringed instrument comprises a supporting frame, a plurality of pokers, at least one picker, a plurality of actuating devices and a computer interface; at least one tension controller may also bey attached. The frame supports the stringed instrument as well as the pokers, picker, tension controller and actuating devices. Each poker, when activated, will press a specific point on a specific string to the neck of the stringed instrument. A picker, when activated, will draw a pick across a string. A tension controller, under activation, can tighten and/or loosen the tension of a string. The actuating devices provide the means of actuating the pokers, picker and tension controller. The computer interface enables the various actuating devices, and thus the apparatus, to be controlled via computer. A stringed instrument may be played, producing music with a broad variety of notes, chords and styles when the various components are activated in an orchestrated manner.

13 Claims, 1 Drawing Sheet

70
73
76
71
54
72
74
75
24
25
10f
7b
8c
30b
34d
10m
36
30a
8
33b
34b
32b
35
33a
32a
34c
32e
32f
37
34a
32d
32c
38
30c
50a
10e
10
50
54
20
7c
10l
10c
10f
54
10b
50d
10h
40
10j
7b
8
30a
30c
7a
10d
54
50c
10a
60
10i
7
10g
61
20a
21
20b
22
23
10f
24
25
8a
7b
8b
44
8f
43
10k
42
7c
50b
41
40
45

APPARATUS FOR PLAYING A STRINGED INSTRUMENT present invention relates to an apparatus for playing a stringed instrument such as a guitar, bass guitar, banjo or the like.

Various devices for playing a stringed instrument are known. Most known devices are controlled manually, that is to say by means of hands and/or feet, and subsequently are quite limited in the variety of the combinations of sounds they can make and the speed at which they can operate. Examples of such devices are described and illustrated in U.S. Pat. No. 66519, dated Jul. 3, 1900, granted to Miller for a "Guitar Support And Player", and in Canadian Patent No. 273986, dated Sep. 20, 1927, granted to Pfaff for a "Mechanical Device For The Playing Of A Guitar".

The present invention seeks to overcome these and other disadvantages of the known devices.

The present invention relates to an apparatus for playing an instrument having a plurality of strings arranged for being picked. In one embodiment of the invention, the apparatus comprises holding means operable for holding the instrument to be played; a plurality of poker means, each operable to applying pressure at a predetermined position on one of the strings in response to a first electronic signal; picker means including a pick and operable for drawing the pick across at least one string in response to a second electronic signal and a computer means operable for being programmed for producing a plurality of electronic signals including the first and second electronic signals for controlling the poker means and the picker means respectively; whereby the instrument can be played.

The poker means and picker means include actuating devices for mechanically operating the respective means.

The instrument holder may be part of a frame which also comprises the supports for the poker means, and the picker means. The picker means may include a linear motion device, enabling the pick to be drawn along a linear locus. The pick may be mounted on a pendulum or on a rotational device. The poker means may include springs. The poker means may have two positions—resting and activated. The poker means, alternatively, may have three positions—resting, muting and activated.

The invention may further comprise at least one tension controller means including a tension controller operable for the adjustment of the tension of one or more strings. The invention also includes support means for the support of the tension controller in its position to relative to the stringed instrument; and an actuating device for mechanically controlling the tension controller. The tension controller can be responsive to a third electronic signal from the computer.

The support means for the tension controller may be integrated into the frame. The tension controller may be attached to the string at the head of the stringed instrument. The tension controller, alternatively, may be attached to the string on the body of the stringed instrument. The actuating devices may include electric motors. The actuating devices may also include solenoids. In addition, the actuating devices may be fluid power cylinders with solenoid valves.

In another aspect of the invention, the apparatus comprises an instrument holder; a plurality of poker means comprising fluid power cylinders equipped with solenoid valves to enable the application of pressure to various points on the respective strings; a plurality of picker means mounted respectively on a plurality of rotational devices and connected respectively to electric motors to enable the drawing of each pick means across respective strings; a plurality of tension controllers connected respectively to the electric motors, to enable the individual adjustments of respective strings; means for the support of the poker means, the picker means, the tension controllers and the actuating devices in their respective positions relative to the stringed instrument; a compressor means operable for creating pressure; transmission means operable for the transmission of pressure from the compressor means to the fluid power cylinders; a computer and a computer interface connected to the solenoid valves and the electric motors to enable the operations to be controlled by the computer.

The instrument holder and the supports for the poker means, picker means, tension controllers and actuating devices may be part of the frame. The fluid for the fluid power cylinders can be gas but is preferably a liquid. The electric motors are preferably stepper motors. The poker means preferably have three positions: resting, muting and activated.

The invention is described with reference to the drawings in which.

Figures 1, 2, 3, 4, 5:
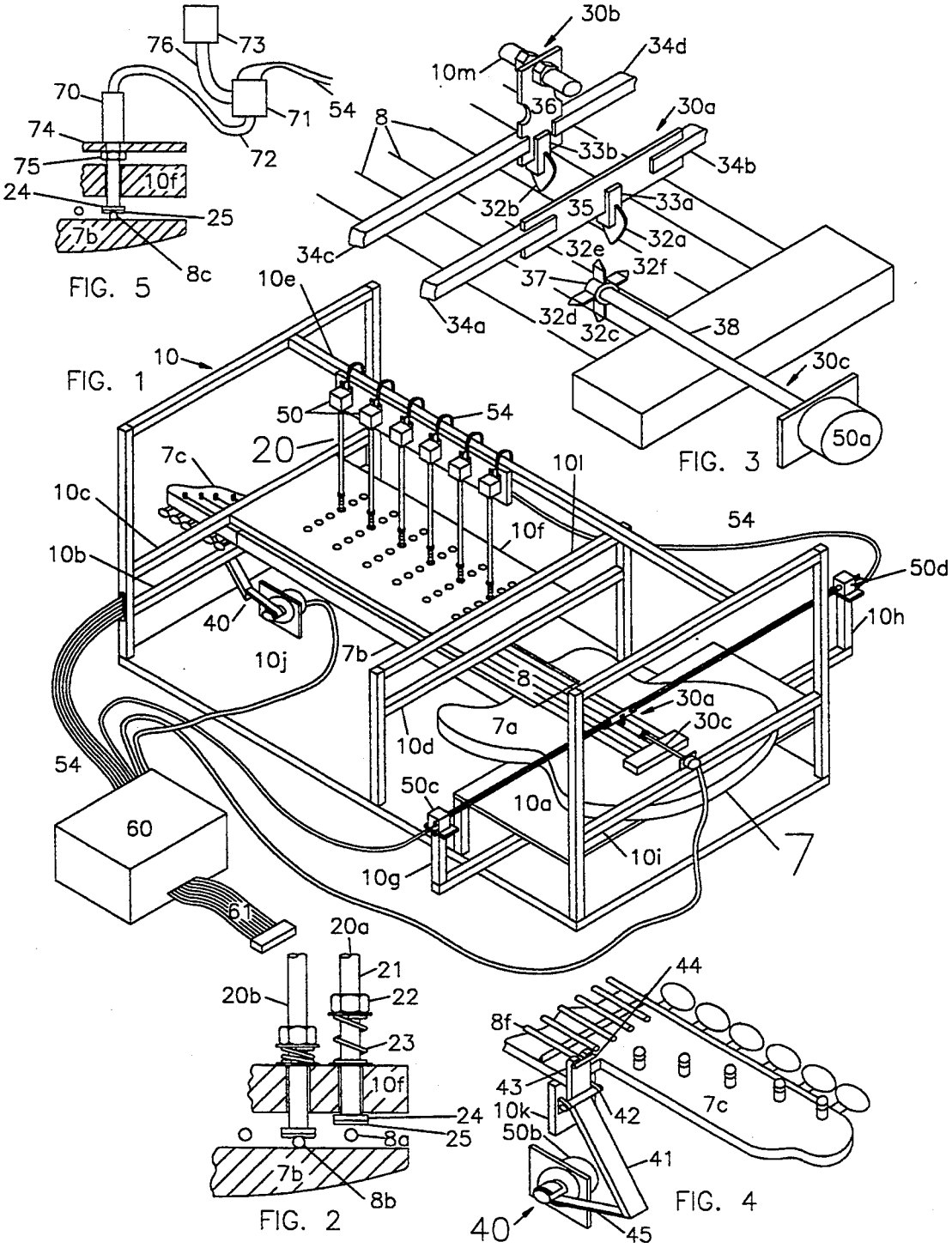
FIG. 1 is a perspective view of an embodiment of the invention connected to an instrument having six strings, with a portion of the components of the invention removed to provide greater clarity.
FIG. 2 is a partial cross-sectional view of part of the neck of the stringed instrument and part of the holeboard showing two pokers, one in the resting position and one in the activated position as viewed parallel to the strings.
FIG. 3 is a simplified perspective view of a portion of the invention showing three different embodiments of the picker, these being the pendulum picker, the linear motion picker and the rotational picker.
FIG. 4 is a simplified perspective view of a tension controller connected to one string of a stringed instrument.
FIG. 5 shows an actuating system suitable for the invention and operated by a fluid power system.

Referring to the drawings, an embodiment of the invention shown in FIG. 1 comprises many primary elements including a supporting frame 10, a plurality of pokers 20, one or more pickers 30*a*, 30*c*, a plurality of actuating devices 50 and a computer interface 60. The computer interface 60 can be based on the Universal Interface System" disclosed in the book, "Build your Own Universal Computer Interface" by Dr. Bruce Chubb, TAB books, Blue Ridge Summit, Pa.<1989. See particularly FIG. 1—1 and pages 3–6. The Book discloses serial and parallel interfaces, however, parallel was used in a prototype of the invention. The prototype included four output cards connected into a mother board and each card had 24 output lines; of the 96 output lines available, only 88 were used and connected to solenoids. The solenoids were powered from 24 VDC.

In addition, a tension controller 40 is shown. The frame 10 supports, the stringed instrument 7 on elements 10*a* and 10*b*; the pokers 20 on elements 10*c*–10*f*; the pickers 30 on elements 10*g*–10*i* and 10*l*–10*m* (element 10*m* is shown in FIG. 3); the tension controller 40 on elements 10*j* and 10*k* (element 10*k* is shown in FIG.

4); and the actuating devices 50 on elements 10*e* and 10*g–j*.

It is evident that many components have been omitted from FIG. 1 for clarity and the components not shown are obvious. For example, not all of the poker means have been shown.

As seen in FIG. 2, each poker 20*a* and 20*b* has a shaft 21 and a head 24. A pad 25 is attached to the head 24 and a spring 23 is on the shaft 21 between the holeboard 10*f* and a fastener 22. The shaft 21 is connected to an actuating device 50 shown in FIG. 1. In FIG. 2, the poker 20*a* appears in the resting position, while the poker 20*b* in FIG. 2 is shown in the activated position.

In FIG. 3, the three embodiments of the picker 30 are shown. The linear motion picker 30*a* has a pick 32*a*, a pickholder 33*a* and a bar 35 which is connected to actuating devices 50*c*–50*d* shown in FIG. 1 by bars 34*a* and 34*b*. Movement of the pick 32*a* is reciprocal and engages the selected string 8 accordingly. The pendulum picker 30*b* has a pick 32*b* and a pickholder 33*b* attached to a pendulum 36, which is suspended from element 10*m* which is connected to the frame 10; the pendulum 36 is connected to actuating devices 50 (not shown) by bars 34*c* and 34*d* in a similar arrangement to picker 30*a*; however, here the movement of bars 34*c* and 34*d* results in rotational movement of pick 32*b* relative element 10*m*. The rotating picker 30*c* has one or more picks 32*c*–32*f* and a pickholder 37 attached to a shaft 38 which extends from an actuating device 50*a* operable to rotate shaft 38, thereby enabling the picks 32*c–f* to engage a selected string 8. The rotational speed of the shaft 38 can vary the volume of the sound produced.

In addition, changing the depth of the picks 32*c–f* relative to the string will also change the volume. The change in depth can be accomplished easily by hinging the arrangement and moving the pickholder 37 with a stepper motor (not shown).

The tension controller 40, shown in FIG. 4, has a lever 41, a fulcrum 42, a forked end 43 and a belt 45; the belt 45 is attached to the actuating device 50*b*. The tension controller 40 is mounted on the elements 10*j*, shown in FIG. 1 and 10*k* (10*k* is attached to 10*b*); the head 7*c* of the stringed instrument 7 is altered to facilitate the attachment of the string 8*f* to the tension controller 40; a small crossbar 44 is fitted onto the end of the string 8*f* which will then catch the forked end 43 of the tension controller 40. Rotation of the actuating device 50*b* changes the position of the lever 41 which changes the position of the forked end 43, thereby changing the tension on the string 8*f*.

It is not necessary to physically alter the head of the instrument 7 to use the tension controller 40. Instead, the tension controller 40 can be arranged with a bar (not shown) near the neck end of the instrument 7 and the strings can be extended to the bar and modified with crossbar 44. In this arrangement, the bar replaces element 10*k* for the changing of the tension on the strings. The solenoids for the poker means were purchased from Guardian and models 28-C-24D and 28 P-C-24D were used. These solenoids operated on 24 VDC at 200 mA with a 10 ounce force at ⅛ inch and a holding force of 67 ounces. The solenoids for the picker means were also from Guardian and were model 11HD-C-24D. These operated on 24 VDC at 300 mA with a 30 ounce force at ⅛ inch and a holding force of 152 ounces. Each picker means used two solenoids.

FIGS. 1, 3 and 4 illustrate two types of actuating devices 50: the electric motors 50*a* and 50*b* and the solenoids 50*c* and 50*d*. The third type is the fluid power cylinder equipped with a solenoid valve; this requires a compressor and a means of pressure transmission between it and the fluid power cylinders. The choice of the actuating device mechanism is a design choice. All of the actuating devices 50 are typically any of the three types; however, it would be preferable for the picker 30*c* to use a rotational driver such as a motor.

As shown in FIG. 1, all of the actuating devices 50 are connected to the computer interface 60 by wires 54, and the computer interface is connected to a suitable computer such as an IBM compatible computer via the ribbon wire 61. The computer program can be written in many languages, even a simple language such as BASIC. The particular program will vary depending on the individual and can be carded out in a straightforward manner. Initially, the programmer would identify the output addresses for the actuating devices to be operated and the remainder of the work is in accordance with well known techniques. To build this invention, the physical layout of the mechanical components, particularly the actuating devices, should be considered because of the physical sizes of the components which must operate in a relatively small space.

FIG. 1 shows pan of an embodiment that will play one string of the six-stringed instrument 7. Adding pokers, pickers and tension controllers and with a certain amount of stacking and staggering actuating devices and bending shafts and bars, the apparatus in FIG. 1 will play six strings. Additionally, this could be facilitated by replacing the stringed instrument shown with a customized one having a far more spacious design although a special instrument is not required at all to practice the invention.

Employing fluid power cylinders as the actuating devices for the pokers requires a minimal amount: of staggering actuating devices and bending shafts and facilitates the installation of the maximum number of pokers. Selecting electric motors or solenoids as the actuating devices for the pokers necessitates a great amount of staggering actuating devices and bending shafts, while limiting the number of pokers that may be installed.

It is also quite possible to place the actuating devices on the reverse side of the stringed instrument and employ a pulling action on the poker shaft rather than a pushing action; moreover, whether with far more powerful actuating devices or the employment of levers or pulleys, the actuating devices could be placed further laterally. The outside strings may be operated by actuating devices such as pull type solenoids below the instruments while the middle four strings may be operated by push type solenoids above the instrument 7 such as actuating devices 50. A poker may be designed to have two positions, resting and activated, i.e. away from the string and holding the string to the neck of the stringed instrument; or it may be designed to have three positions, resting, muting and activated, and muting would be described as contacting the string but not pressing it to the neck of the stringed instrument.

Considering the pickers, a three-tiered extension of the frame with staggered supports would facilitate the employment of the rotating pickers with electric motors as the actuating devices; this option would have the staggered shafts arriving from slightly different angles. Alternatively, either the linear motion pickers or the pendulum pickers could easily be installed with staggering of pickers, stacking of actuating devices (of any type) and alignment of connectors.

With the tension controllers one must again consider, when designing the frame, where the actuating devices will be located. While by extending belts and altering angles it is quite possible to locate all the actuating devices in the same area, one may also locate some of the tension controllers and their actuating devices on the other side of the stringed instrument or outward laterally.

Any suitable computer interface may be used; it must be able to control each actuating device individually and so should have a few hundred output lines. Any suitable size and strength in the various actuating devices may be used; various actuating devices in the 24 VDC and 300 mA range are suitable, as are numerous others.

FIG. 5 shows a partial sectional view of an embodiment using fluid power. The neck of the guitar 7*b* has string 8*c* being compressed under the head of poker 24. Holeboard 10*f* is positioned above the guitar 7. A fluid power cylinder 70 is mounted on plate 74 with fastener 75. A hose 72 is connected to a controller such as solenoid valve 71 which is connected through hose 76 to compressor 73 and through wires 54 to an interface device.

Once the apparatus according to the invention is built and connected to a computer, it is operated by means of the computer. Assuming a suitable computer program is running, the way the apparatus operates is quite simple. A poker is activated and exerts pressure on a certain point on a string, pinching the string to the neck of the stringed instrument; the picker for that string is activated and draws the pick across the string, causing the string to vibrate and emit a tone; additionally, the tension controller for that string may be activated to tighten and/or loosen the string, causing the tone to be raised and/or lowered, thus adding to the sound a quality termed 'feeling'.

But the apparatus need not operate merely one string at a time; it can play all strings at once or staggered, and can thus produce many interesting sounds, some of which can be emulated by the known art and some of which cannot. This apparatus, while capable of emulating many sounds produced by the known art, may not be able to produce all the sounds produced by the known art. The advantages of this apparatus are its programmability and its versatility in the production of sounds and combinations of sounds; not only can it produce an enormous quantity of notes and chords with almost any amount of 'feeling', this apparatus can do this without memory lapses or mistakes for extended periods of time. Furthermore, it can achieve speeds and combinations beyond human capabilities.

The embodiments disclosed are intended only to illustrate the invention without limiting the scope thereof; the present invention includes all variations and modifications within the scope of the claims.

What is claimed is:

1. An apparatus for playing an instrument having a plurality of strings arranged for being picked, said apparatus comprises holding means operable for holding said instrument to be played; a plurality of poker means, each operable for applying pressure at a predetermined position on one of the strings in response to a first electronic signal; picker means including a pick and operable for drawing the pick across at least one string in response to a second electronic signal; and a computer means operable for being programmed for producing a plurality of electronic signals including the first and second electronic signals for controlling the poker means and the picker means, respectively; whereby the instrument can be played.

2. The apparatus as claimed in claim 1, wherein said picker means comprises a linear motion means operable for moving said pick along a generally linear path.

3. The apparatus as claimed in claim 1, wherein said picker means comprises a pendulum means operable for moving said pick along a path defined by a pendulum.

4. The apparatus as claimed in claim 1, wherein said picker means comprises a rotational means operable for moving said pick along a rotational path.

5. The apparatus as claimed in claim 1, further comprising: at least one tension controller means operable for the adjustment of the tension of one or more strings.

6. The apparatus as claimed in claim 1 wherein at least one of said poker means includes a solenoid, operable to be activated by said computer means.

7. The apparatus as claimed in claim 1 wherein at least one of said poker means includes an electric motor, operable to be activated by said computer means.

8. The apparatus as claimed in claim 1 wherein at least one of said poker means includes a fluid power cylinder, operable to be activated by said computer means.

9. The apparatus as claimed in claim 1 wherein said picker means includes a solenoid, operable to be activated by said computer means.

10. The apparatus as claimed in claim 1, wherein said picker means comprises an electric motor, operable to be activated by said computer means.

11. The apparatus as claimed in claim 1, wherein said picker means includes a fluid power system, operable to be activated by said computer means.

12. The apparatus as claimed in claim 1, wherein said computer means comprises a computer and a computer interface means operable for convening signals from said computer to said picker means and said poker means.

13. An apparatus for playing an instrument having a plurality of strings arranged for being picked, said apparatus comprises holding means operable for holding said instrument to be played; a plurality of poker means, each operable for applying pressure at a predetermined position on one of the strings in response to a first electronic signal; picker means including a pick and operable for drawing the pick across at least one string in response to a second electronic signal; and computer interface means operable for receiving signals from a computer and producing a plurality of electronic signals including the first and second electronic signals for controlling the poker means and the picker means, respectively; whereby the instrument can be played.

* * * * *